United States Patent [19]

Könnemann et al.

[11] 4,077,698

[45] Mar. 7, 1978

[54] CONDUCTOR, CLAW, AND METHOD AND APPARATUS FOR ITS PRODUCTION

[75] Inventors: Alfred Könnemann; Rudolf Reinertz, both of Wuppertal, Germany

[73] Assignee: Grote & Hartmann, Wuppertal, Germany

[21] Appl. No.: 748,544

[22] Filed: Dec. 8, 1976

[30] Foreign Application Priority Data

Dec. 11, 1975 Germany ..... 2555709

[51] Int. Cl.[2] ..... H01R 5/08

[52] U.S. Cl. ..... 339/276 R

[58] Field of Search ..... 339/97 C, 276

[56] References Cited

U.S. PATENT DOCUMENTS 3,668,615 6/1972 Bury ..... 339/276 T

FOREIGN PATENT DOCUMENTS 1,033,433 7/1953 France ..... 339/276 T

OTHER PUBLICATIONS

IBM Bulletin, Cioffi et al., 3-1966, p. 1328.

*Primary Examiner*—Joseph H. McGlynn
*Attorney, Agent, or Firm*—Michael J. Striker

[57] ABSTRACT

The conductor claw includes a bent bottom section and claw arms outwardly adjoining the bent bottom section at the two sides thereof. The claw arms are bent towards the longitudinal axis of the conductor claw. The end sections of the claw arms are curved. Each claw arm includes intermediate the curved bottom section of the conductor claw and the curved end section of the respective claw arm a straight section which merges tangentially into the respective curved end section. Each claw arm has at the bend therein an inner knee and an outer knee, and each curved end section of the claw arms has an inner curve and an outer curve. The centers of the inner and outer curves of each curved end section are located on a first line spaced from each other a distance corresponding to the thickness of the material of the conductor claw. The first line extends parallel to a second line which passes through both the inner and the outer knee of the respective claw arm.

8 Claims, 5 Drawing Figures

CONDUCTOR, CLAW, AND METHOD AND APPARATUS FOR ITS PRODUCTION

BACKGROUND OF THE INVENTION

The invention relates to conductor claws, particularly for electrical connectors made of stamped sheet metal, of the type having a bottom with claw arms extending outwardly therefrom to both sides.

Known conductor claws for electrical connectors made of stamped sheet metal are usually bent to have a generally U- or V-shape and generally have an insulation part and a conductor wire part, with each claw part having a bottom adjoined at both sides thereof by claw arms or claw-arm-like extensions. In the production of the claws, the ends of the claw arms are stamped in such a manner as to form stamped points. Thereafter, the fashioning is performed, in which the conductor claw parts are bent to have approximately a U-shape with arms pointing slightly outward. To fasten them to electrical conductors, the conductor claws are deformed further, preferably to have an M-crimp, with the insulation part embracing the insulation of the conductor and the conductor wire part embracing the conductor wire. The stamped points at the ends of the claw arms penetrate into the insulation or into the conductor wire, as the case may be, and in this way anchor the electrical connector to the electrical conductor wire or, alternatively, the conductor wire claw establishes the electrical contact.

Because of the preselected shape for the conductor claw, the fastening of the electrical connector requires relatively powerful fastening tools. Additionally, the dies of these tools are subject to considerable wear; this is because the pointed ends of the claw arms, produced by upset stamping, slide along the die surface and become upset back toward the bottom of the claw before they are actually rolled in to form the M-crimp.

SUMMARY OF THE INVENTION

It is an object of the invention to provide a conductor claw of such a design as to present only a low deformation resistance to be overcome during the crimping operation, and furthermore so designed that it can be shaped in a simple manner using simple tools.

According to one advantageous concept of the invention, this is achieved by providing a conductor claw comprised of a bent bottom section outwardly adjoined at both sides by claw arms. The claw arms are bent relative to the longitudinal axis of the conductor claw, and the claw arm ends, which adjoin the bends in the claw arms, are curved. The bends in the claw arms are preferably located relative to the longitudinal axis of the claw and relative to the claw arm ends in such a manner that the distance from the longitudinal axis to the bend in the claw arm, on the one hand, and the distance from the bend in the claw arm to the claw arm end, stand in a ratio of from 1.1 : 1 to 2 : 1.

According to a preferred concept of the invention, the inner and outer radii of curvature of each claw arm end are equal. This results in a tapering of each claw arm end in the shape of a stamped point. According to a further concept of the invention, the bend in the claw arm is immediately adjoined by a linearly extending part which merges tangentially into the curved part. In that event, it is particularly advantageous that the middle points of the two curves of each curved part of the claw arm be spaced from each other a distance corresponding to the thickness of the material of the conductor claw, and that they be located on a line which is parallel to a line passing through both the outer and inner bend of the bend in the respective claw arm.

Preferably, the line on which the two middle points of the two curves of each part of the claw arm are located is, in turn, located between the line passing through the inner and outer bends of the claw arm bend, on the one hand, and the respective claw arm end, on the other hand. In that event, it is advantageous that the ratio of the radius of curvature r, on the one hand, to the perpendicular spacing X between the line joining the middle points and the line passing through the inner and outer bends of the claw arm, on the other hand, be between 2 : 1 and 4 : 1, preferably 3 : 1. It has been found that this design makes for an extremely small deformation resistance to be overcome and reduces the wear experienced by the dies used in the crimping operation; also, when the claw is rolled into a crimp, a hollow space is formed in which the electrical conductor is embraced but not squashed.

The fashioning of the conductor claw is performed in such a way that the initially flat stamped sheet metal part is, first of all, simultaneously bent, curved and stamped to a point in a single operating step; thereafter, the bottom section of the claw is rolled. With this inventive production technique, what is achieved is that the stamped point is formed by flow of material at the claw arm end; compared to upset stamping, which in general is performed independently of the rolling of the claw, this expedient requires a low consumption of energy. Additionally, there is avoided the formation of edges such as could produce wear upon the surfaces of the crimping tools.

To perform the inventive method, use is made of a die set comprised of an upper die and a lower die. The upper and lower die surfaces have the same shape and are both symmetrical to the longitudinal axis. Each die has a bend extending parallel to the longitudinal axis, the bend being adjoined by a planar extending section which merges tangentially into a curved section. During the fashioning, the stamped sheet metal part of the conductor claw, whose width substantially corresponds to that of the die set, is bent, curved and stamped to a point by flow-stamping between the upper and lower dies in one operating step. The bottom section of the claw is then rolled in to assume the desired shape by means of another tool.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
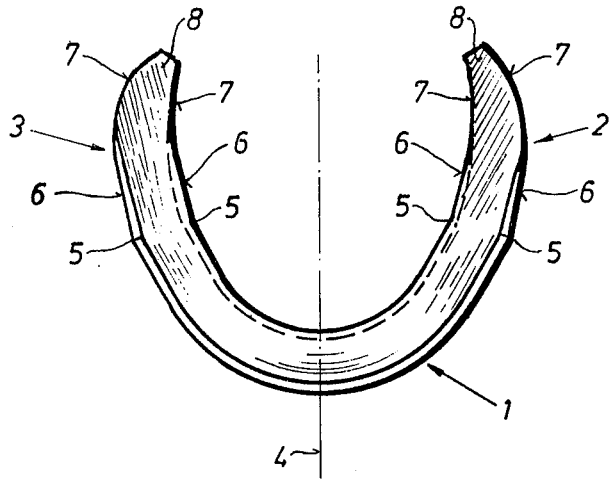
FIG. 1 depicts an exemplary conductor claw in cross-section.
Figure 2:
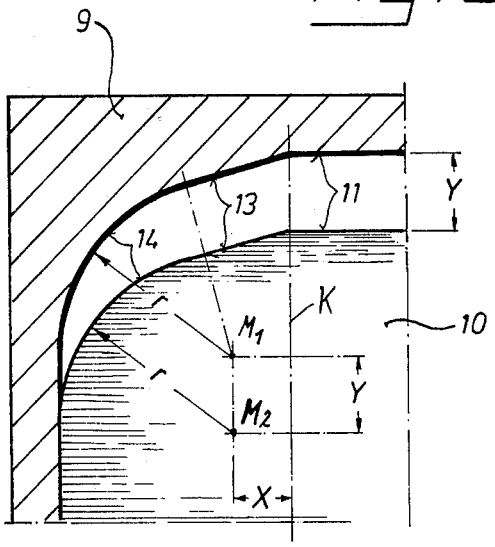
FIG. 2 depicts part of an apparatus for performing the inventive method, in cross-section.
Figure 3:
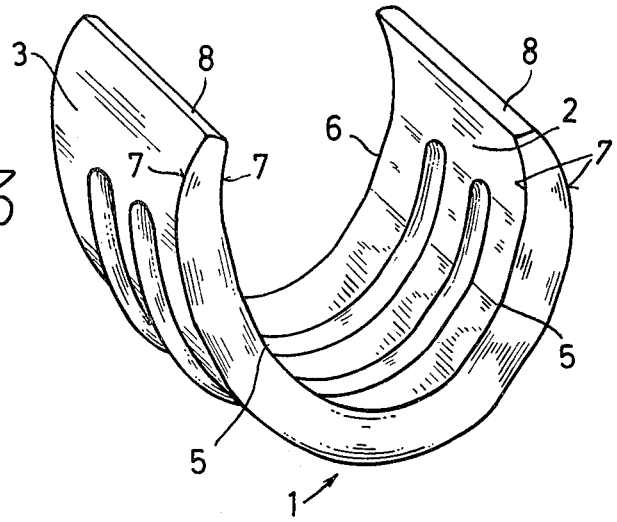
FIG. 3 depicts a perspective view of the conductor claw.
Figure 4:
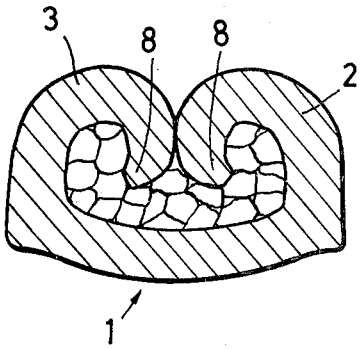
FIG. 4 depicts the crimped conductor claw in cross-section.
Figure 5:
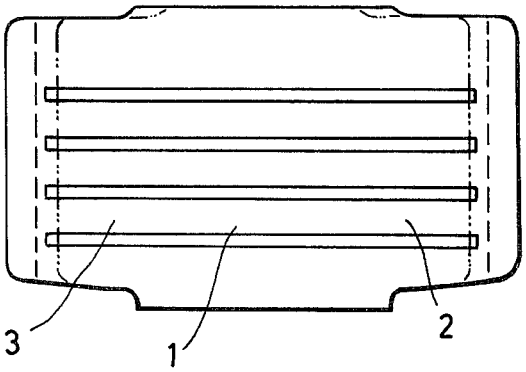
FIG. 5 depicts the shape of the sheet metal part before it is fashioned into the claw.

The illustrated conductor claw has a bottom section 1 rolled into a U-shape and two claw arms 2 and 3. A bend 5 is provided in each claw arm in about the second third of the way from the longitudinal axis 4 of the claw. Adjoining each bend 5 is a straight part 6 which merges into a curved part 7. The ends 8 of the claw arms 2 and 3 are tapered or stamped to a point.

The inventive apparatus used for fashioning the conductor claw comprises an upper die 9 and a lower die 10. The facing surfaces of the dies 9 and 10 are the same. The dies 9, 10 have respective planar parts 11 extending away from the longitudinal axis. Adjoining the planar parts 11 are angled parts 13 which likewise extend planar and merge into curved parts 14. The radii of curvature of the upper and lower dies are equal. The centers M1, M2 of the curved parts 14 lie on a straight line spaced apart a distance Y. Distance Y corresponds to the thickness of the material used for the claw. The line joining the center points M1, M2 is spaced a distance X from a line K passing through the bends of both dies 9, 10.

Importantly, the inventive conductor claw is characterized not only by lowered resistance to rolling-in during the crimping operation and by reduced wear upon the crimping tools; additionally, surprisingly good results are obtained with respect to the ability of the connection to withstand torsional loads, vibrational forces, corrosion and extracting forces, as compared to the corresponding characteristics of conventional, fastened claws. The inventive conductor claw is superior with respect to all comparisons which can be made. Additionally, all relevant electrical characteristics of the fastened claw are considerably better than those of conventional conductor claws. These good mechanical and electrical characteristics are achieved irrespective of whether the claws are fastened by machine or using hand tools.

Preferably, the inventive conductor claw will be provided on a plug socket or connector socket. However, it can be disposed on other types of electrical connectors made of stamped sheet metal.

It will be understood that each of the elements described above, or two or more together, may also find a useful application in other types of constructions, designs and fashioning techniques, differing from the types described above.

While the invention has been illustrated and described as embodied in a conductor claw and fashioning apparatus of particular design, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A conductor claw, comprising a bent bottom section, claw arms adjoining the bent bottom section at the two ends thereof, the conductor claw having two inwards bends, one bend being located at the junction between one end of the bent bottom section and the adjoining claw arm, the other bend being located at the junction between the other end of the bent bottom section and the adjoining claw arm, the end sections of the claw arms being curved, each curved claw arm end section having an inner radius of curvature and an outer radius of curvature equal thereto, each claw arm including intermediate its respective end section and the respective inward bend a straight section which merges tangentially into the respective curved end section.

2. The conductor claw defined in claim 1, the bend in each claw arm being located between the longitudinal axis of the claw and the end of the respective claw arm, the distance between the longitudinal axis and the bend in the claw arm, on the one hand, and the distance between the bend in the claw arm and the end of the respective claw arm, on the other hand, standing in a ratio between 1.1 : 1 and 2 : 1.

3. The conductor claw defined in claim 1, each claw arm having at the bend therein an inner knee and an outer knee, each curved end section of the claw arms having an inner curve and an outer curve, the centers of the inner and outer curves of each curved end section being located on a first line spaced from each other a distance corresponding to the thickness of the material of the conductor claw, the first line extending parallel to a second line which passes through both the inner and the outer knee of the respective claw arm.

4. The conductor claw defined in claim 3, the first line being intermediate the second line and the respective claw arm end, the ratio between the radii of curvature of each curved claw arm end section, on the one hand, and the perpendicular spacing between the first and second lines, on the other hand, being between 2 : 1 and 4 : 1.

5. The conductor claw defined in claim 4, the ratio being about 3 : 1.

6. A method of producing the conductor claw defined in claim 1, comprising taking a sheet metal part having the bottom section and the claw arms and effecting the bending of the claw arms, the curving of the end sections of the claw arms and also stamping of the end sections of the claw arms to form points simultaneously in a single operating step, and thereafter rolling the bottom section to impart the bend thereto.

7. The method defined in claim 6, the stamping of the end sections of the claw arms to form points comprising the use of flow stamping.

8. An apparatus for performing the method defined in claim 6, comprising an upper die and a cooperating lower die, the facing surfaces of the upper and lower dies being the same and symmetrical to the longitudinal axis of the dies, each of the facing surfaces of the dies having a bend extending parallel to the longitudinal axis, and a planar section adjoining the bend, and a curved section which adjoins the planar section, the planar section merging tangentially into the curved section.

* * * * *